US006082535A

United States Patent [19]

Mitchell

[11] Patent Number: 6,082,535

[45] Date of Patent: Jul. 4, 2000

[54] PROTECTIVE COVERING FOR A CELL PHONE OR A PAGER

[76] Inventor: Burke H. Mitchell, 7557 N. Dreamy Draw Dr, #130, Phoenix, Ariz. 85020

[21] Appl. No.: 09/233,895

[22] Filed: Jan. 20, 1999

[51] Int. Cl.[7] ..... B65D 85/00

[52] U.S. Cl. ..... 206/320; 206/811; 150/154; 150/165; 53/441

[58] Field of Search ..... 206/320, 497, 206/811; 383/84, 112, 907; 150/161, 162, 165, 154; 53/441

[56] References Cited

U.S. PATENT DOCUMENTS

| | | | |
|---|---|---|---|
| 3,954,177 | 5/1976 | Faust | 206/497 |
| 4,185,742 | 1/1980 | Fisk et al. | 206/811 |
| 4,584,718 | 4/1986 | Fuller | 455/351 |
| 4,746,043 | 5/1988 | Booker | 224/219 |
| 4,763,783 | 8/1988 | Talbot | 206/497 |
| 4,901,852 | 2/1990 | King | 206/320 |
| 4,993,092 | 2/1991 | Weeks | 5/508 |
| 5,025,921 | 6/1991 | Gasparaitis et al. | 206/320 |
| 5,080,155 | 1/1992 | Crozier | 150/154 |
| 5,092,459 | 3/1992 | Uljanic et al. | 206/320 |
| 5,140,800 | 8/1992 | Martin et al. | 53/441 |
| 5,172,795 | 12/1992 | Riceman | 190/26 |
| 5,265,720 | 11/1993 | Meliconi | 206/305 |
| 5,383,091 | 1/1995 | Snell | 361/679 |
| 5,456,277 | 10/1995 | Pontius, Jr. | 135/90 |
| 5,467,576 | 11/1995 | Hendriks | 53/441 |
| 5,499,713 | 3/1996 | Huffer | 206/320 |
| 5,547,051 | 8/1996 | Bartscht et al. | 190/26 |
| 5,551,497 | 9/1996 | Stanley | 150/154 |
| 5,812,188 | 9/1998 | Adair | 206/320 |

*Primary Examiner*—David T. Fidei
*Attorney, Agent, or Firm*—Antonio R. Durando

[57] ABSTRACT

A protective covering for a communications device includes a resilient water-impermeable bag which is of one piece. The bag has a single opening through which the communications device can be inserted in the bag, and a layer of adhesive runs around the opening on the inside of the bag. The adhesive layer is covered by a nonadhesive strip which can be peeled off to expose the adhesive layer. When the bag is closed following removal of the nonadhesive strip, the adhesive layer forms a water-impermeable seal for the opening of the bag.

15 Claims, 2 Drawing Sheets

PROTECTIVE COVERING FOR A CELL PHONE OR A PAGER

BACKGROUND OF THE INVENTION

1. Field of the Invention

The invention relates to a protective covering for a communications device.

2. Description of the Prior Art

Cell phones, pagers and hand-held two-way radios currently enjoy tremendous popularity. These communications devices are carried along virtually everywhere and, as such, are inevitably exposed to the elements and are also liable to be dropped in puddles, snow, or sand.

Since water and dust can affect the operation of, and even ruin, a cell phone, a pager, or a hand-held two-way radio, protective coverings have been developed for such communications devices. However, none of these coverings forms an entirely satisfactory barrier to water.

SUMMARY OF THE INVENTION

It is an object of the invention to shield communications devices from water and other undesirable elements more effectively.

The preceding object, as well as others which will become apparent as the description proceeds, are achieved by the invention.

One aspect of the invention resides in a one-shot, i.e., single-use or disposable, protective covering for a communications device. The covering comprises a one-piece elastically deformable bag with a single opening. The bag has an undeformed condition and an expanded condition, and the bag is designed to fully enclose the communications device when the bag is in the expanded condition. The bag is further designed so that the communications device is insertable in the bag only upon expansion of the bag from the undeformed condition. The covering additionally comprises a layer of adhesive on the bag arranged to permit substantially complete sealing of the opening in the expanded condition of the bag, and both the adhesive and bag are substantially water-impermeable.

In accordance with the invention, a protective covering for a communications device includes a bag for reception of the device. The bag is of one piece and has a single opening which can be substantially completely sealed by an adhesive. The bag, as well as the adhesive for sealing the opening, are substantially water-impermeable. By virtue of these features, the covering enables the communications device to be well-protected from water.

Inasmuch as the bag is elastic and designed so that the communications device can be inserted therein only when the bag is expanded, the bag can shrink onto the communications device and conform to the contour thereof. This makes it possible for individual elements of the communications device, e.g., operating keys, to be recognizable from the outside and the communications device to be gripped easily by hand.

Another aspect of the invention resides in a communications article. The article comprises a protective covering free of openings, and the covering includes a water-impermeable elastically deformable bag as well as water-impermeable bonding material sealing the bag against water. The article also comprises a communications device inside the bag, and the bag elastically grips the device.

An additional aspect of the invention resides in a method of protecting a communications device. The method comprises the steps of elastically expanding a substantially water-impermeable bag, and inserting the communications device in the bag while performing the expanding step. The method further comprises the steps of elastically gripping the communications device with the bag when the communications device is in the bag, and sealing the bag with substantially water-impermeable bonding material while performing the gripping step.

Other features and advantages of the invention will be forthcoming from the following detailed description of preferred embodiments when read in conjunction with the accompanying drawings.

DESCRIPTION OF THE PREFERRED EMBODIMENTS

Figures 1, 2:
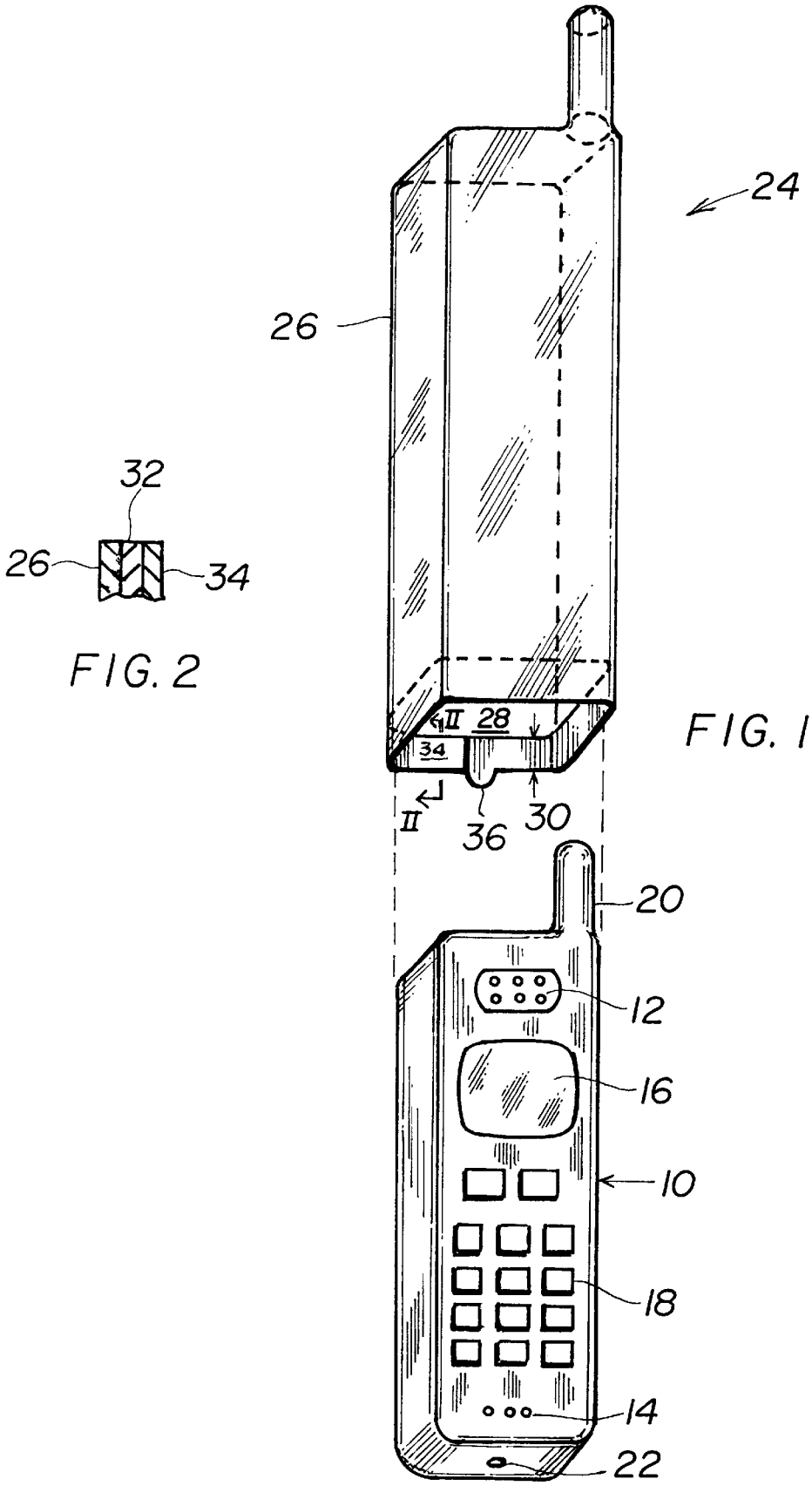
FIG. 1 is a perspective view of a communications device and a covering according to the invention for protecting the device, the covering being open to receive the device.
FIG. 2 is an enlarged fragmentary sectional view in the direction of the arrows II—II of FIG. 1.

Referring to FIG. 1, the numeral 10 identifies a communications device. The device 10 is exemplified by a cell phone but could also be a pager or any other device which can receive signals from a remote sender and/or transmit signals to a remote receiver. The cell phone 10 has an earpiece 12, a mouthpiece 14, a display screen 16, a keypad 18, an antenna 20 and a jack recess 22.

The cell phone 10 is in the process of being inserted in a protective covering 24. The covering 24 includes an elastic or resilient bag or pouch 26 which is of one piece. The bag 26 can be elastically expanded or stretched from an undeformed condition, and the bag 26 tends to return to this condition when elastically expanded.

The bag 26 has an opening 28 which serves for insertion of the cell phone 10 in the bag 26, and the opening 28 constitutes the sole opening of the bag 26. The opening 28 adjoins a margin 30 of the bag 26, and the margin 30 extends circumferentially of the bag 26 and circumscribes the opening 28. Considering FIG. 2 in conjunction with FIG. 1, the inner surface of the margin 30, that is, the surface of the margin 30 facing the opening 28, is provided with a layer 32 of adhesive or bonding material. The adhesive layer 32 here runs the length of the margin 30 although this may not be necessary. The main design consideration for the adhesive layer 32 is that the latter be able to completely seal the opening 28 when the bag 26 is closed.

Upon closing the bag 26, the adhesive layer 32 forms a permanent seal for the opening 28 so that the bag 26 cannot be opened without cutting or otherwise destroying the bag 26. Accordingly, the protective covering 24 is a one-shot or disposable item, i.e., the protective covering 24 is used once and then discarded.

The bag 26 and the adhesive constituting the layer 32 are water-impermeable. Furthermore, the protective covering 24 is designed to enclose the cell phone 10 entirely when the bag 26 is sealed. Thus, since the bag 26 is a one-piece item and has only the one opening 28 which is completely sealed by the adhesive layer 32 when the bag 26 is closed, the protective covering 24 is capable of effectively shielding the cell phone 10 from water.

The adhesive layer 32 is covered with a nonadhesive strip or layer 34 which prevents the bag 26 from being sealed inadvertently. The strip 34 is provided with a tab 36 which can be grasped to peel the strip 34 from the adhesive layer 32.

The protective covering 24 is designed so that it is not possible to insert the cell phone 10 therein without expanding the bag 26 from its undeformed condition. This insures that the bag 26 elastically grips the cell phone 10 and conforms to the contour thereof after the cell phone 10 has been placed in the bag 26. FIG. 1 shows the bag 26 being held in an expanded condition for insertion of the cell phone 10 in the bag 26.

Figure 3:
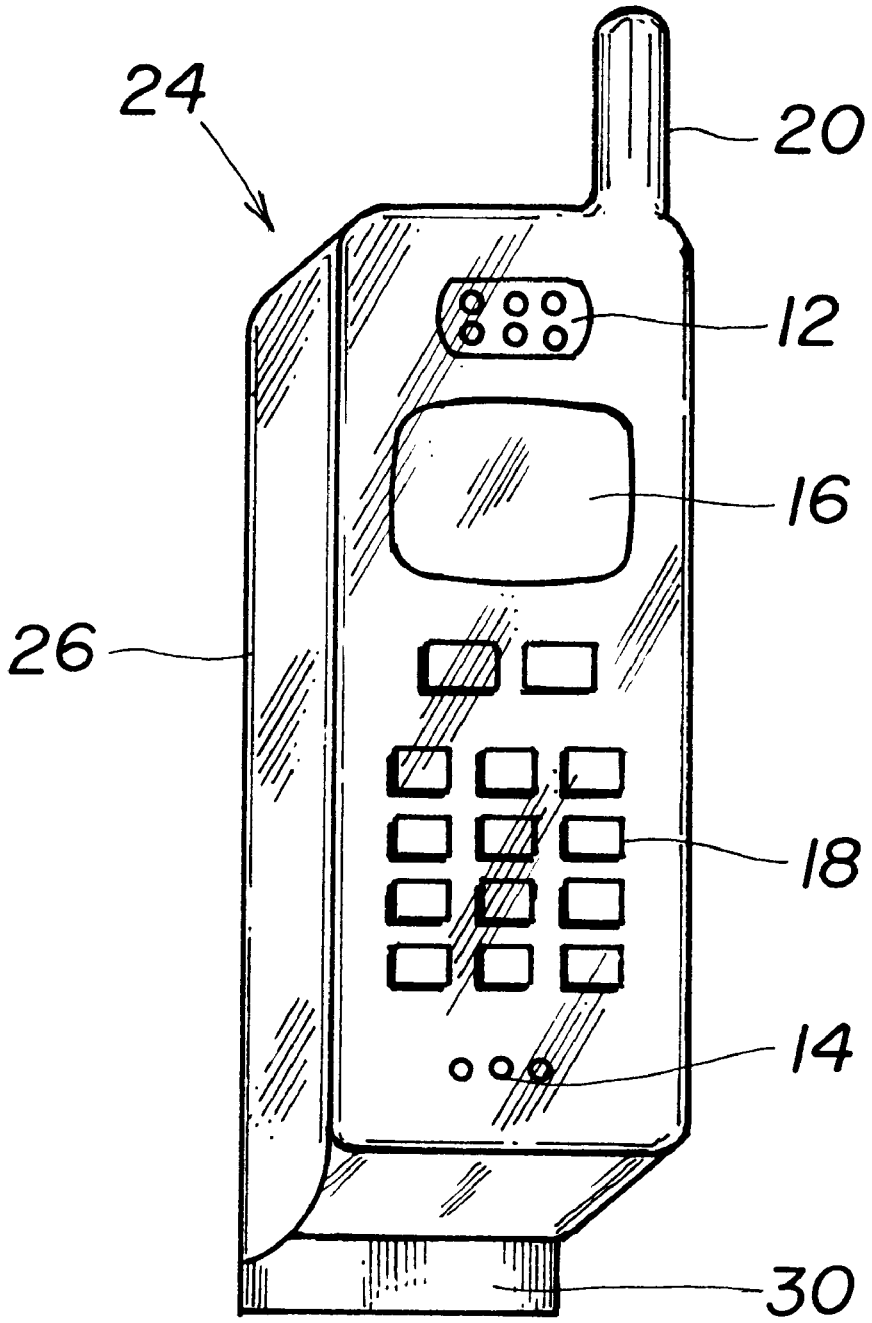
FIG. 3 is a perspective view of the covering of FIG. 1 after the covering has been sealed following insertion of the communications device therein.

FIG. 3 illustrates the protective covering 24 once the cell phone 10 has been placed in the bag 26 and the latter has been sealed by the adhesive layer 32. The bag 26 has shrunk somewhat from the condition of FIG. 1 where the bag 26 was being forcefully expanded to a size sufficiently large to insert the cell phone 10 therein. However, the bag 26 is still in an expanded condition in FIG. 3 since the cell phone 10 is too large to permit the bag 26 to return to its undeformed condition. Since the tendency of the bag 26 is to shrink to the undeformed condition thereof, the bag 26 elastically grips the cell phone 10 and conforms to the contour of the same. Accordingly, the outlines of the earpiece 12, the mouthpiece 14, the display screen 16, the keypad 18 and the antenna of the cell phone 10 are visible in the bag 26.

To permit identification of the keys of the keypad 18 for dialing purposes, the bag 26 is preferably semitransparent or transparent. Furthermore, the bag 26 should be capable of transmitting the sounds coming from the earpiece 12 as well as the sounds spoken into the mouthpiece 14. The bag 26 is advantageously designed to transmit sound with little or no distortion or attenuation. The bag 26 should also be capable of transmitting the electrical signals necessary for the operation of the cell phone 10.

By way of example, the bag 26 can be made of latex or vinyl. Both latex and vinyl are resilient, capable of transmitting sound and electrical signals, and at least semitransparent in the form of thin sheets, Assuming that the bag 26 is in its undeformed condition, a method of protecting the cell phone 10 from water is as follows:

The bag 26 is elastically expanded at least in the area of the opening 28. While the bag 26 is elastically expanded, the cell phone 10 is inserted in the bag 26 via the opening 28.

It was previously mentioned that the bag 26 can accommodate the entire cell phone 10. In fact, the cell phone 10 can fit inside the bag 26 without obstructing the rim 30, and the cell phone 10 is positioned in the bag 26 in this manner. Since, as indicated earlier, the cell phone 10 is too large for the bag 26 when the latter is in its undeformed condition, the bag 26 elastically grips the cell phone 10 and conforms to the contour thereof.

Once the cell phone 10 has been placed in the bag 26, the tab 36 of the nonadhesive strip 34 is grasped to peel the strip 34 from the adhesive layer 32. The opening 28 of the bag 26 is then completely sealed by the adhesive layer 32.

The protective covering 24 effectively shields the cell phone 10 from water. This is so because the bag 26 is of one piece, is water-impermeable and has only one opening 28 which is completely sealed by the water-impermeable adhesive layer 32. Furthermore, since the bag 26 is resilient and must be elastically expanded to accommodate the cell phone 10, the protective covering 24 conforms to the contour of the cell phone 10. This allows individual elements of the cell phone 10 to be recognizable from the outside of the protective covering 24.

Various modifications are possible within the meaning and range of equivalence of the appended claims. For instance, the seal formed by the adhesive layer 32 can be replaced by a heat seal and the position and size of the antenna extension portion 20 may vary depending on application.

I claim:

1. A one-shot protective covering for a communications device comprising:

a one-piece stretchably deformable bag with a single opening, said bag having an undeformed condition and an expanded condition, and said bag being designed to fully enclose the communications device when said bag is in said expanded condition, said bag being further designed so that the communications device is insertable in said bag only upon expansion of said bag from said undeformed condition; and a layer of adhesive on said bag arranged to permit substantially complete and permanent sealing of said opening in said expanded condition, said adhesive and said bag being substantially water-impermeable.

2. The covering of claim 1, further comprising a substantially nonadhesive layer on said adhesive layer.

3. The covering of claim 1, wherein said bag has a semitransparent or transparent portion.

4. The covering of claim 1, wherein said bag has a sound-transmitting portion.

5. The covering of claim 1, wherein said bag consists essentially of latex or vinyl.

6. A communications article comprising:

a protective covering free of openings, said covering including a water-impermeable stretchably deformable bag, and water-impermeable bonding material permanently sealing said bag against water; and a communications device inside said bag, said bag elastically gripping said device.

7. The article of claim 6, wherein said bonding material comprises an adhesive.

8. The article of claim 6, wherein said bag has a semitransparent or transparent portion.

9. The article of claim 6, wherein said bag has a sound-transmitting portion.

10. The article of claim 6, wherein said bag consists essentially of latex or vinyl.

11. A method of protecting a communications device comprising the steps of:

elastically expanding a substantially water-impermeable bag;

inserting said communications device in said bag while performing the expanding step;

elastically gripping said communications device with said bag when said communications device is in said bag; and permanently sealing said bag with water-impermeable bonding material while performing the gripping step.

12. The method of claim 11, wherein said bonding material comprises an adhesive.

13. The method of claim 11, wherein said bag has a semitransparent or transparent portion.

14. The method of claim 11, wherein said bag has a sound-transmitting portion.

15. The method of claim 11, wherein said bag consists essentially of latex or vinyl.

* * * * *